US011692704B2

(12) United States Patent
Revilla et al.

(10) Patent No.: US 11,692,704 B2
(45) Date of Patent: Jul. 4, 2023

(54) SYSTEMS AND METHODS FOR DYNAMIC BOILER CONTROL

(71) Applicant: Rheem Manufacturing Company, Atlanta, GA (US)

(72) Inventors: Jorge Miguel Gamboa Revilla, Oxnard, CA (US); Amin Monfared, Oxnard, CA (US); Shaun Besse, Oxnard, CA (US)

(73) Assignee: RHEEM MANUFACTURING COMPANY, Atlanta, GA (US)

( * ) Notice: Subject to any disclaimer, the term of this patent is extended or adjusted under 35 U.S.C. 154(b) by 270 days.

(21) Appl. No.: 16/871,170

(22) Filed: May 11, 2020

(65) Prior Publication Data

US 2021/0348754 A1 Nov. 11, 2021

(51) Int. Cl.
*F22B 35/18* (2006.01)

(52) U.S. Cl.
CPC ..... *F22B 35/18* (2013.01)

(58) Field of Classification Search
CPC ..... F22B 35/18
See application file for complete search history.

(56) References Cited

U.S. PATENT DOCUMENTS 2,283,059 A * 5/1942 Harrison ..... G05B 11/44 236/70
4,362,499 A * 12/1982 Nethery ..... F23N 5/003 236/15 E
5,993,194 A * 11/1999 Lemelson ..... F23N 5/082 700/47
6,019,593 A * 2/2000 Lewandowski ..... F23N 1/027 431/89

(Continued)

FOREIGN PATENT DOCUMENTS

EP 3301362 A1 4/2018
GB 2052725 A * 1/1981 ..... F23N 5/003

(Continued)

OTHER PUBLICATIONS

SCC inc, LMV5 Application Guide , Jul. 9, 2014, https://www.stromquist.com/customer/docs/SKUDocs/LMV5%20Application%20Guide.pdf (Year: 2014).*

(Continued)

*Primary Examiner* — Steven S Anderson, II
(74) *Attorney, Agent, or Firm* — Eversheds Sutherland (US) LLP

(57) ABSTRACT

Systems and methods for dynamic boiler control are disclosed. The system can receive flue gas data from a flue gas sensor and can receive blower data associated with a blower of the boiler. The system can determine, based at least in part on the blower data, a current fire status of the boiler and can provide one or more fire-status-specific parameters based on the current fire status of the boiler. The system can compare the flue gas data to a target flue gas value, and in response to determining that the flue gas data is less than the target flue gas value, the system can execute one or more boiler operation rules using the one or more fire-status-specific parameters. The system can output instructions for adjustment of an air-fuel ratio of the boiler based on the boiler operation rules and the one or more fire-status-specific parameters.

19 Claims, 5 Drawing Sheets

(56) References Cited

U.S. PATENT DOCUMENTS

| | | | | |
|---|---|---|---|---|
| 2009/0223466 | A1* | 9/2009 | Knorr, Jr. ..... | F22B 35/00<br>122/448.1 |
| 2017/0350589 | A1* | 12/2017 | Zala ..... | F22B 9/08 |

FOREIGN PATENT DOCUMENTS

| | | | |
|---|---|---|---|
| RU | 2247900 | C2 | 3/2005 |
| RU | 2539222 | C1 | 1/2015 |
| RU | 2715302 | C1 | 2/2020 |
| WO | 2015038994 | A1 | 3/2015 |

OTHER PUBLICATIONS

International Search Report and Written Opinion for PCT Application No. PCT/US2021/031686 dated Aug. 19, 2021.

* cited by examiner

SYSTEMS AND METHODS FOR DYNAMIC BOILER CONTROL

FIELD OF INVENTION

Examples of the present disclosure relate to systems and methods for dynamic boiler control and, in particular, to systems and methods for optimizing combustion efficiency regardless of external conditions and/or different boiler operational ranges.

BACKGROUND

Boilers and other devices are typically mass-manufactured to perform according to predetermined and unchanged device settings. Once sold and installed, however, the same make and model of a boiler or other device can operate under wildly different environmental or ambient conditions. For example, a boiler installed in Denver, Colo. will likely experience different environmental conditions as compared to the same make/model of boiler installed in Miami, Fla. Further, a boiler installed in Chicago, Ill. is more likely to experience significant temperature swings and/or low-pressure systems. And as will be appreciated, boilers located in different environmental conditions can perform differently, even with all other variables being equal. For example, differences in ambient air pressure and/or ambient temperature can affect the density of air, which can affect combustion within the boiler, which can affect the efficiency of the boiler.

Further, it would be logistically cumbersome, time-consuming, and/or cost-prohibitive to know where a given boiler will be eventually installed and altering the settings of that particular boiler to maximize combustion efficiency in the eventual installation location. Moreover, a boiler could be subsequently moved to a different environment and/or weather changes could negatively impact combustion efficiency.

Thus, it can be difficult to ensure a boiler or other device is operating efficiently given environmental concerns.

Accordingly, there is a need for systems and methods for dynamic boiler control that accurately determine combustion efficiency and dynamically adjust a boiler's operation in response to external conditions and/or different boiler operational ranges. Examples of the present disclosure are directed to this and other considerations.

SUMMARY

Examples of the present disclosure comprise systems and methods for dynamic boiler control. As mentioned above, data indicative of the concentration of certain flue gases can be used to determine whether full performance of the boiler is being achieved. Referring to FIG. 1, it can be appreciated that changes in the concentration of any of the flue gases can signal a movement away from optimal combustion by the boiler. As shown in FIG. 1, however, oxygen provides the most linear curve and can be used to estimate boiler performance at any given time. While other flue gases can be used to estimate boiler performance, oxygen may provide the simplest option, in view of its near-linear curve. Nonetheless, the operation of a boiler is not linear, and because traditional boiler control techniques utilize certain controller coefficients that are designed for a high range of firing rates, such traditional boiler control techniques can be inefficient when the boiler is operating within certain other firing rate ranges, such as low firing rate ranges. To address these and other inefficiencies, it can be useful to adjust the operation of the boiler based on the operation of the blower to better characterize the response of the gases with respect to changes to fuel- or air-intake of the boiler. As explained herein, the disclosed technology can provide system adaptability for a boiler, even at firing rate ranges that are non-linear.

To that end, Proportional-Integral-Derivative ("PID") controllers can be utilized to provide increased accuracy and control over commercial control systems, such as boilers. However, when setting up a PID loop control, PID values are typically selected according to the process to be controlled, and challenges can arise when the process to be controlled includes non-linear behavior. The disclosed technology can help simplify such non-linear behavior, particularly with respect to boiler control, using one or more linear processes.

A PID control according to the disclosed technology can help increase efficiency of a boiler by relating the boiler's operation to key gases that are byproducts of combustion and which include carbon monoxide, carbon dioxide, and oxygen (i.e., excess of oxygen). These gases, which can be measured in the flue of the boiler, can indicate the efficiency by which fuel is being burned. Moreover, of the flue gases, oxygen concentrations can typically provide the most accurate estimate of a combustion efficiency at a given time. This can be because, as illustrated by FIG. 1, oxygen can provide the most linear curve of the flue gases. Also, because boiler performance can be affected by external conditions (e.g., external temperature, external air pressure, etc.), it can be important to monitor and adjust the operation of the boiler based on these external conditions. Therefore, it can be beneficial to monitor the concentrations of at least one of these gases and maintain proper tuning of the corresponding concentrations by adjusting characteristics of the boiler's operating accordingly, such as altering the current air-fuel ratio (e.g., adjusting the shutter of the boiler to increase or decrease a current flow of fuel).

The method can include outputting for display, by a display associated with the boiler, the target flue gas value, the flue gas data, the current flue gas data, the updated flue gas data, the blower data, and/or the updated blower data.

The disclosed technology includes a method for dynamically controlling a boiler. The method can include receiving flue gas data from a flue sensor (e.g., a sensor at or in a flue of the boiler) and receiving blower data associated with a blower of the boiler. The method can include determining, based at least in part on the blower data, a current fire status of the boiler. The current fire status can be one of at least two fire statuses of the boiler. The method can include providing one or more fire-status-specific parameters based on the current fire status of the boiler. The method can include comparing the flue gas data to a target flue gas value and in response to determining that the flue gas data is indicative of a flue gas concentration that is less than the target flue gas value, executing one or more boiler operation rules using the one or more fire-status-specific parameters. The method can include outputting instructions for adjustment of an air-fuel ratio of the boiler based on the boiler operation rules and the one or more fire-status-specific parameters.

Outputting instructions for adjustment of the air-fuel ratio of the boiler can include outputting instructions for a fuel shutter to open a certain amount based on the boiler operation rules and the one or more fire-status-specific parameters. Alternatively, outputting instructions for adjustment of the air-fuel ratio of the boiler can include outputting instructions for a fuel shutter to open a certain amount based on the boiler operation rules and the one or more fire-status-specific parameters.

Outputting instructions for adjustment of the air-fuel ratio of the boiler can include outputting instructions for the fuel shutter to open or close at a certain speed based on the boiler operation rules and the one or more fire-status-specific parameters.

Outputting instructions for adjustment of the air-fuel ratio of the boiler can include outputting instructions for the blower to increase a current blower output based on the boiler operation rules and the one or more fire-status-specific parameters. Alternatively, outputting instructions for adjustment of the air-fuel ratio of the boiler can include outputting instructions for the blower to decrease a current blower output based on the boiler operation rules and the one or more fire-status-specific parameters.

Outputting instructions for adjustment of the air-fuel ratio of the boiler can include outputting instructions for the blower to increase or decrease the current blower output at a certain rate of change based on the boiler operation rules and the one or more fire-status-specific parameters.

Providing the one or more fire-status-specific parameters can include providing one or more high-fire parameters if the current fire status of the boiler is a high-fire status, providing one or more mid-fire parameters if the current fire status of the boiler is a mid-fire status, or providing one or more low-fire parameters if the current fire status of the boiler is a low-fire status.

The method can include receiving updated flue gas data and updated blower data, and the method can include determining an updated current fire status of the boiler based at least in part on the updated blower data. The method can include providing one or more updated fire-status-specific parameters based on the updated current fire status of the boiler. The method can include comparing the updated flue gas data to the target flue gas value and, in response to determining that the updated flue gas data is indicative of an updated flue gas concentration that is less than the target flue gas value, executing the one or more boiler operation rules using the one or more updated fire-status-specific parameters. The method can include outputting updated instructions for adjustment of the air-fuel ratio of the boiler based on the boiler operation rules and the one or more fire-status-specific parameters.

The method can include displaying, by a display, at least one of the flue gas data, the blower data, a determined combustion efficiency of the boiler, and the current fire status of the boiler.

The flue gas data can include excess of oxygen data.

The flue gas data can include at least one of carbon dioxide data, which can be indicative of a concentration of carbon dioxide in the flue of the boiler, and carbon monoxide data, which can be indicative of a concentration of carbon monoxide in the flue of the boiler.

The disclosed technology includes a non-transitory, computer-readable medium having instructions stored thereon that, when executed by one or more processors, causes a system to perform some or all of the methods described herein.

The disclosed technology includes a boiler controller that includes the non-transitory, computer-readable medium described herein. Stated otherwise, the disclosed technology includes a boiler controller configured to perform some or all of the methods described herein. The boiler controller can include one or more processors.

The disclosed technology includes a boiler including the boiler controller described herein.

Further features of the disclosed design, and the advantages offered thereby, are explained in greater detail hereinafter with reference to specific examples illustrated in the accompanying drawings, wherein like elements are indicated be like reference designators.

BRIEF DESCRIPTION OF THE DRAWINGS

Reference will now be made to the accompanying drawings, which are not necessarily drawn to scale, are incorporated into, and constitute a portion of, this disclosure, illustrate various implementations and aspects of the disclosed technology and, together with the description, serve to explain the principles of the disclosed technology. In the drawings.

DETAILED DESCRIPTION

Figure 1:
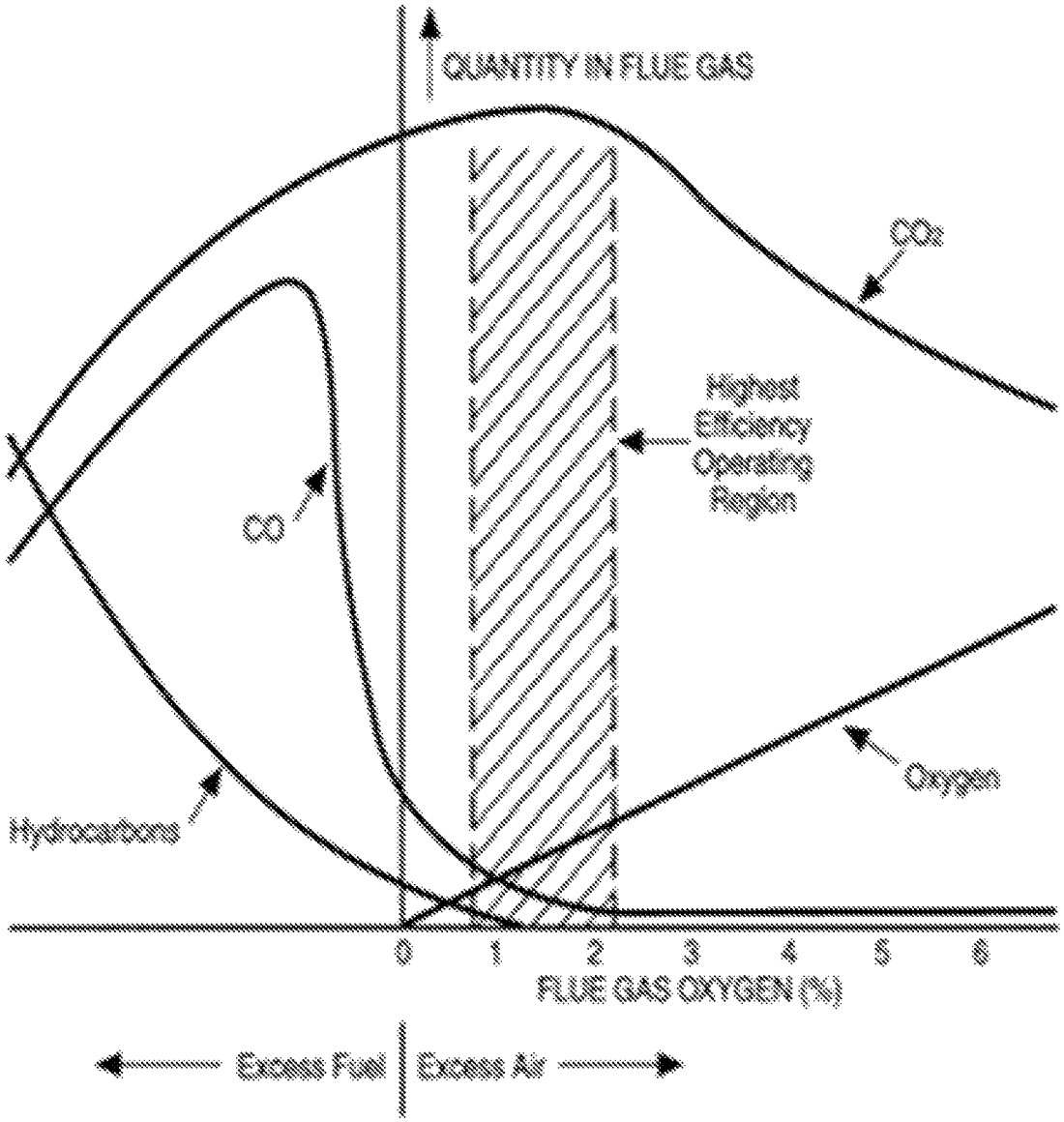
FIG. 1 illustrates a graph showing concentrations of flue gasses of a boiler.

Examples of the present disclosure relate to systems and methods for dynamic boiler control. The system can be configured to output instructions for efficient operation of a boiler based on flue gas data received from a flue gas sensor. For example, the system can receive excess of oxygen data from an oxygen sensor located in or near a flue of the boiler. The system can compare the flue gas data to a target flue gas value or a target flue gas range of values. If the flue gas data needs to be adjusted to satisfy the target flue gas value or target range of flue gas values (e.g., the flue gas data is below a target flue gas value, the flue gas data is outside a target range of flue gas values), the system can determine that adjustment of the boiler operation is required. The target flue gas value can include a single value or a range of values (e.g., a range of target flue gas values). As an example, a target flue gas value range can be a range defined by an ideal flue gas value ±5%. The system can receive blower data (e.g., data indicative of the current RPM or CFM or other output measurements of the blower), which can be used to determine a fire status (e.g., a high-fire status, a mid-fire status, a low-fire status) of the boiler. Based on the fire status, the system can execute one or more boiler operation rules using one or more parameters specific to the fire status. For example, the system can apply high-fire parameters when the fire status is the high-fire status, mid-fire parameters when the fire status is the mid-fire status, and low-fire parameters when the fire status is the low-fire status. Based on the operation rules and the corresponding parameters, the system can output instructions for adjustment of a shutter of the boiler to increase or decrease the amount of fuel entering the combustion chamber of the boiler. The system can thus adjust the operation of the boiler based on feedback from the flue gases, thereby increasing the efficiency of the combustion process and the overall efficiency of the system.

Various aspects and implementations of the disclosed technology will be described more fully with reference to the accompanying drawings. The disclosed technology, however, can be embodied in many different forms and should not be construed as limited to the implementations expressly set forth herein. The components described hereinafter as making up various elements of the disclosed technology are intended to be illustrative and not restrictive. Many suitable components that could perform the same or similar functions as components described herein are intended to be embraced within the scope of the disclosed systems and methods. Such other components not described herein can include, but are not limited to, components developed after development of the disclosed technology, for example.

It is also to be understood that the mention of one or more method steps does not imply a particular order of operation or preclude the presence of additional method steps or intervening method steps between those steps expressly identified. Similarly, it is also to be understood that the mention of one or more components in a device or system does not preclude the presence of additional components or intervening components between those components expressly identified.

Reference will now be made in detail to example examples of the disclosed technology, examples of which are illustrated in the accompanying drawings and disclosed herein. Wherever convenient, the same reference numbers will be used throughout the drawings to refer to the same or like parts.

Figure 2:
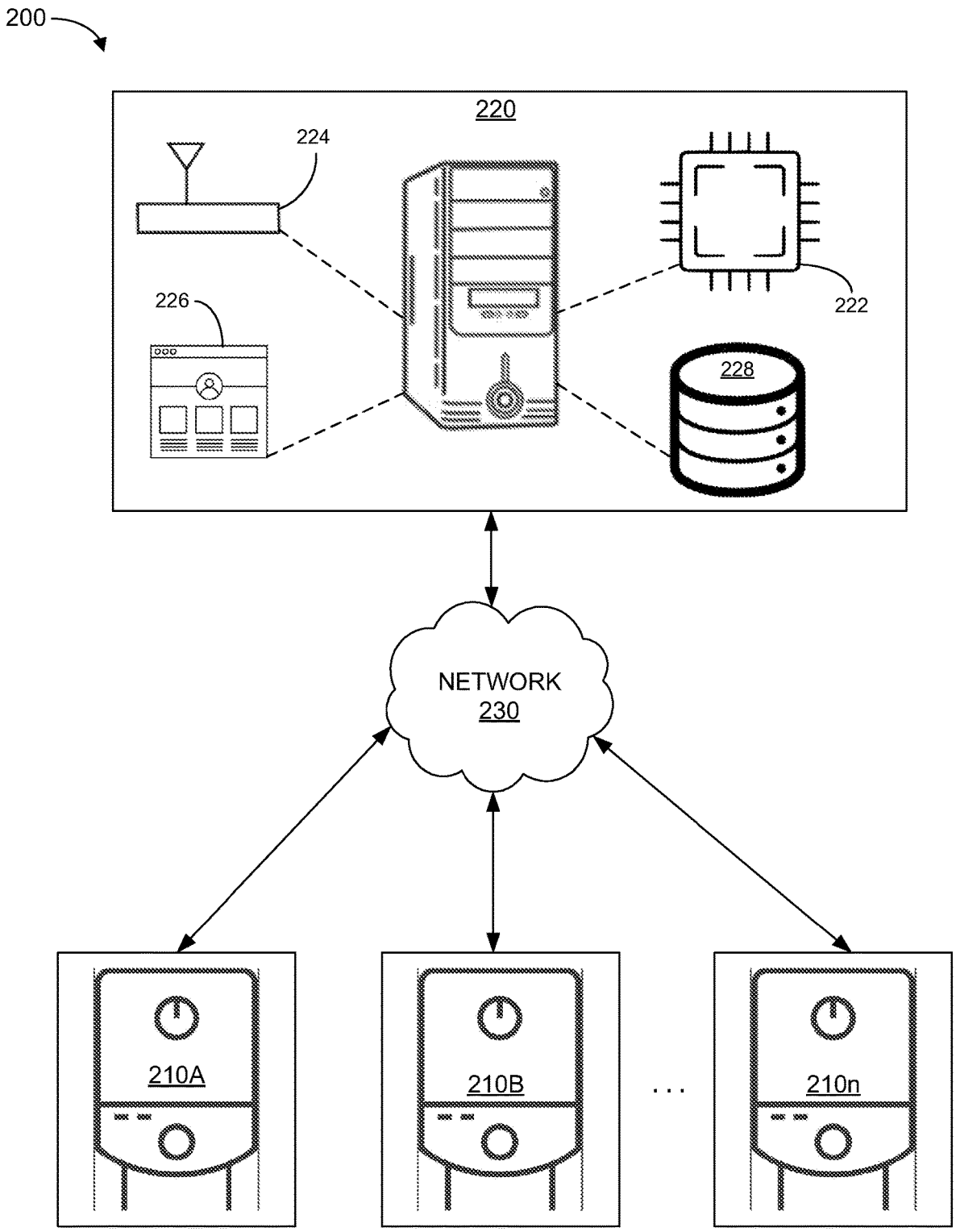
FIG. 2 illustrates a diagram of an example system, in accordance with the disclosed technology.
Figure 5:
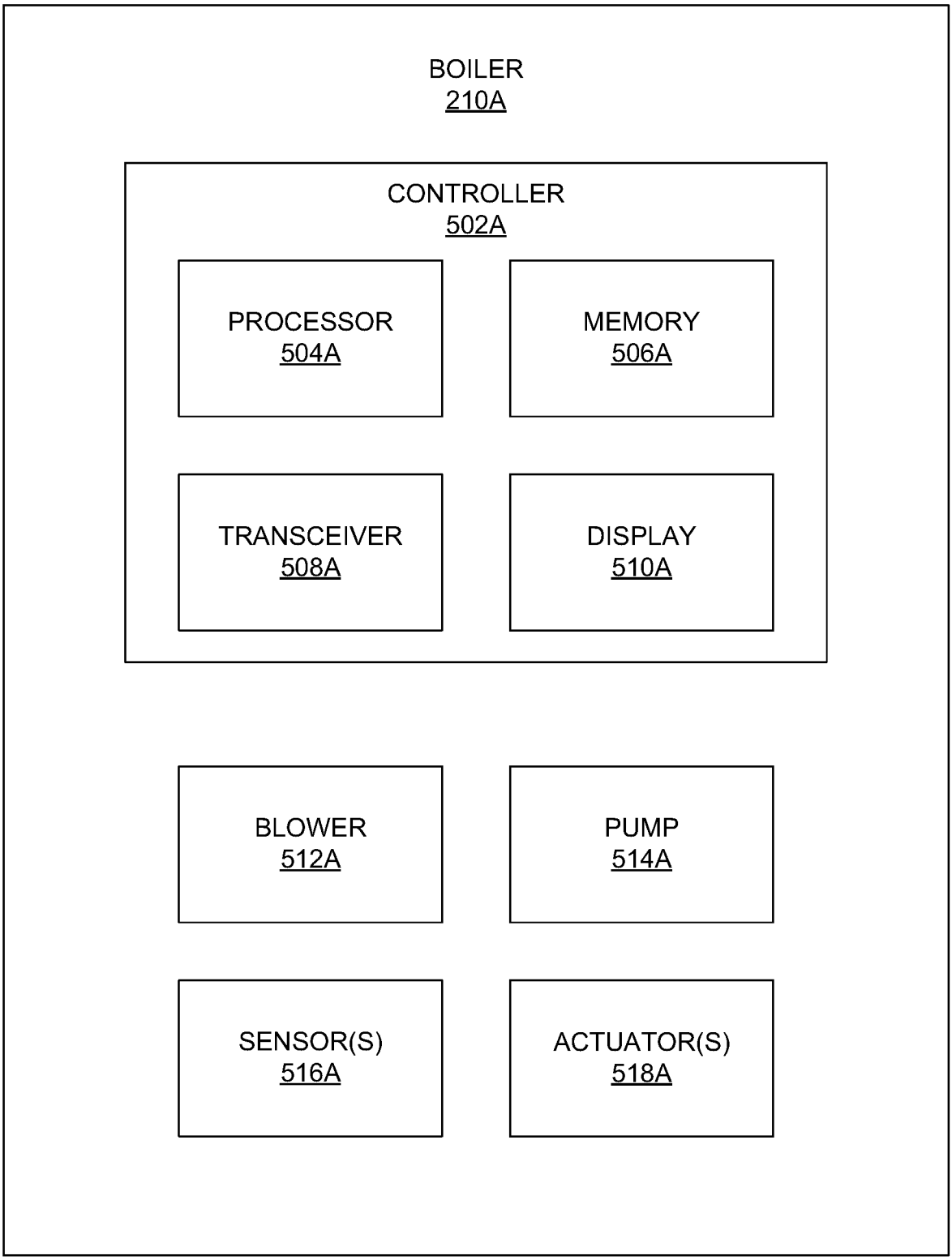
FIG. 5 illustrates a component diagram of an example boiler, in accordance with the disclosed technology.

FIG. 2 shows an example system 200 that can implement certain methods for dynamic boiler control as disclosed herein. As shown in FIG. 2, the system 200 can include one or more boilers 210A-210*n* and a computing device 220 (e.g., a PID controller), which can include one or more processors 222, a transceiver 224, a display 226, and a memory 228, among other things. The computing device 220 can be a cloud computing device and/or an external server in communication with the one or more boilers 210A-210*n*. The computing device 220 can include one or more physical or logical devices (e.g., servers) or drives and can be implemented as a single server, a bank of servers (e.g., in a "cloud"), run on a local machine, or run on a remote server. The network 230 can include a network of interconnected computing devices (e.g., the Internet or a local network). The one or more boilers 210A-210*n* can be commercial boilers and/or residential boilers. An example architecture that can be used to implement the one or more boilers 210A-210*n* is described below with reference to FIG. 5.

To increase the efficiency of combustion in the boiler, the computing device 220 can receive boiler data from the one or more boilers 210A-210*n*. The boiler data can include flue gas data, which can be indicative of a current amount of one or more flue gases (e.g., carbon monoxide data indicative of a current amount of carbon monoxide in the flue, carbon dioxide data indicative of a current amount of carbon dioxide in the flue, and/or oxygen data indicative of a current excess of oxygen or a current amount of oxygen in the flue). Perhaps most commonly used is oxygen data. This may be, as explained as above, because oxygen concentrations in the flue can typically provide the most accurate estimate of a combustion efficiency at a given time. The boiler data can include blower data associated with the speed of the blower (e.g., data indicative of a current number of revolutions per minute (RPM), a current cubic feet of air outputted per minute, or some other output metric of the blower). The blower data can be received from the blower itself or from a sensor that is separate from the blower. The boiler data can include a unique identifier for each boiler. The boiler data can include various types of data corresponding to various aspects related to and/or affecting boiler operation such as, for example, air pressure, airflow changes, supply temperature, return temperature, system demand, and the like. These various types of data can be measured by, and received from, one or more corresponding sensors, such as an air pressure sensor (e.g., a barometer), a flow sensor, a temperature sensor (e.g., a thermocouple, a thermistor), and the like. Data representative of external or environmental conditions (e.g., ambient air pressure, external temperature, etc.) can also be included with the boiler data, or the external conditions data can be received separately.

The computing device 220 can identify a first boiler (e.g., boiler 210A) based by comparing the received unique identifier to a dataset that includes stored unique identifiers associated with various boilers 210A-210*n*. The dataset of stored unique identifiers can be stored in the memory 228. The computing device 220 can thus be configured to instruct boiler operation for two or more boilers 210A-210*n* simultaneously or nearly simultaneously. That is, the computing device 220 can instruct boiler operations based on first boiler data specific to a first boiler 210A while also instructing boiler operations based on second boiler data specific to a second boiler 210B.

The computing device 220 can receive data associated with an external or environmental condition (e.g., external air pressure, supply temperature, return temperature, system demand) associated with the first boiler 210A, and the data can be received from the first boiler 210A itself (or component(s) thereof) and/or from a separate sensor that is associated with the first boiler 210A.

The computing device 220 can determine a current fire status (e.g., high-fire status, mid-fire status, or low-fire status) of the first boiler 210A based on the blower data, and one or more status-specific parameters that each correspond to a respective fire status. For example, one or more high-fire parameters can correspond to a high-fire status, one or more mid-fire parameters can correspond to a mid-fire status, and/or one or more low-fire parameters can correspond to a low-fire status.

The computing device 220 can determine whether the first boiler 210A is operating at a target combustion efficiency by comparing the received flue gas data (e.g., excess of oxygen data) to the target flue gas value or range of target flue gas values. If the target flue gas value or range of target flue gas values is not satisfied, the computing device 220 can execute one or more boiler operation rules using the parameters corresponding to the current fire status. For example, the computing device 220 can execute the boiler operation rule(s) using the high-fire parameter(s) if the boiler 210A is currently operating in a high-fire status. As another example, the computing device 220 can execute the boiler operation rule(s) using the mid-fire parameter(s) if the boiler 210A is currently operating in a mid-fire status. And as yet another example, can execute the boiler operation rule(s) using the low-fire parameter(s) if the boiler 210A is currently operating in a low-fire status. The operating ranges of the blower corresponding to each respective fire status can vary by the type of blower. Further, a particular blower may have two, three, four, five, or more separate fire status. For example, a first blower may have only two fire statuses (e.g., a high-fire status and a low-fire status), whereas a second blower can have four fire statuses (e.g., a highest-fire status, a high-mid-fire status, a low-mid-fire status, and a lowest-fire status). While specific operating ranges corresponding to the respective fire statuses may vary by blower (e.g., make and/or model), an example blower having two fire statuses can have a low-fire status corresponding to the blower operating at 50% or less of the blower's maximum output (e.g., RPM, CFM), and the example blower can have a high-fire status corresponding to the blower operating at greater than 50% of the blower's maximum output. As another example, a blower having three fire statuses can have a high-fire status corresponding to the blower operating at greater than or equal to 67% of the blower's maximum output, a mid-fire status corresponding to the blower operating at greater than 33% of the blower's maximum output and less than 67% of the blower's maximum output, and a low-fire status corresponding to the blower operating at less than or equal to 33% of the blower's maximum output.

The boiler operation rule(s) can include outputting instructions for a shutter of the boiler to adjust (e.g., open or close to a greater or lesser degree) based on boiler operation rules and the corresponding parameter(s). That is, if the fire status is high, the computing device 220 can output instructions for the shutter of the first boiler 210A to adjust based on the boiler operation rule(s) and the high-fire parameter(s). Similarly, the computing device 220 can output instructions to for the shutter of the first boiler 210A to adjust based on the boiler operation rule(s) and the mid-fire parameter(s) if the fire status is the mid-fire status, and the computing device 220 can output instructions to for the shutter of the first boiler 210A to adjust based on the boiler operation rule(s) and the low-fire parameter(s) if the fire status is low. Adjusting the shutter can vary the fuel intake of the first boiler 210A, which changes the air-fuel ratio of the and can ultimately shift the current combustion efficiency of the first boiler 210A toward the target combustion efficiency.

The computing device 220 can include in the instructions a speed by which the shutter is instructed to open or close. The computing device 220 can control the speed by which the shutter opens or closes based on the fire status. For example, the computing device 220 can instruct the shutter to adjust at a relatively fast adjustment speed if the blower is operating at a high-fire status, and the computing device 220 can instruct the shutter to adjust at a relatively slow adjustment speed if the blower is operating at a low-fire status. If the blower is operating at a mid-fire status, the computing device 220 can instruct the shutter to adjust at a medium adjustment speed that is between the fast adjustment speed associated with the high-fire status and the slow adjustment speed associated with the low-fire status.

Alternatively or in addition, the computing device 220 can be configured to output instructions for the blower to increase or decrease its speed or output, thereby effecting a change in the air-fuel ration and increasing combustion efficiency. For example, the instructions can instruct the blower to increase or decrease the blower speed and/or output based on the boiler operation rule(s) and the specific parameter(s) corresponding to the current fire status of the boiler. Optionally, the instructions can include a speed by which the blower is instructed to increase or decrease speed and/or output, and the speed by which the blower is instructed to adjust can be based on the current fire status of the boiler. For example, a high-fire status can correspond to a relatively fast adjustment speed of the blower, and conversely, a low-fire status can correspond to a relatively slow adjustment speed of the blower. A mid-fire status can correspond to an adjustment speed that is between the fast adjustment speed associated with the high-fire status and the slow adjustment speed associated with the low-fire status.

The computing device 220 can receive updated boiler data from the first boiler 210A (e.g., boiler data received after the computing device 220 receives the first boiler data discussed above and/or after the computing device 220 sends the first set of instructions discussed above). The updated boiler data can include all or some of the same fields and/or data types as the boiler data. The computing device 220 can receive subsequent or updated blower data from the blower of the first boiler 210A (e.g., blower data received after the computing device 220 receives the first blower data discussed above and/or after the computing device 220 sends the first set of instructions discussed above). The computing device 220 can repeat the above steps using the updated boiler data and updated blower data. That is, the computing device 220 can use the updated boiler data to determine whether the first boiler 210A is operating at the target combustion efficiency (which can be the same target combustion efficiency as discussed previously), and the computing device 220 can use the updated blower data to determine an updated fire status of the first boiler 210A. Depending on the updated fire status of the first boiler 210A, the computing device 220 can execute boiler operation rules based on the parameter(s) corresponding to the updated fire status, and the computing device 220 can output instructions (e.g., second instructions), accordingly.

Subsequent to outputting instructions, the computing device 220 can determine whether the outputted instructions sufficiently changed the combustion efficiency. If the combustion efficiency has not sufficiently improved (e.g., if the current flue gas data does not satisfy the target flue gas value or range of values), the computing device 220 can output secondary instructions, which can, for example, instruct the shutter to adjust to a greater degree than was instructed in the previous instructions and/or instruct the shutter to adjust a faster or slower speed.

Turning to the boilers 210A-n and using the first boiler 210A as a representative boiler, the first boiler 210A can perform some or all the functions discussed above with respect to the computing device 220. For example, while the computing device 220 can be remote from the first boiler 210A, the first boiler 210A can include an integrated computing device 220 or the like (e.g., a processor and memory storing instructions relating to some or all of the functionalities described herein).

Figure 3:
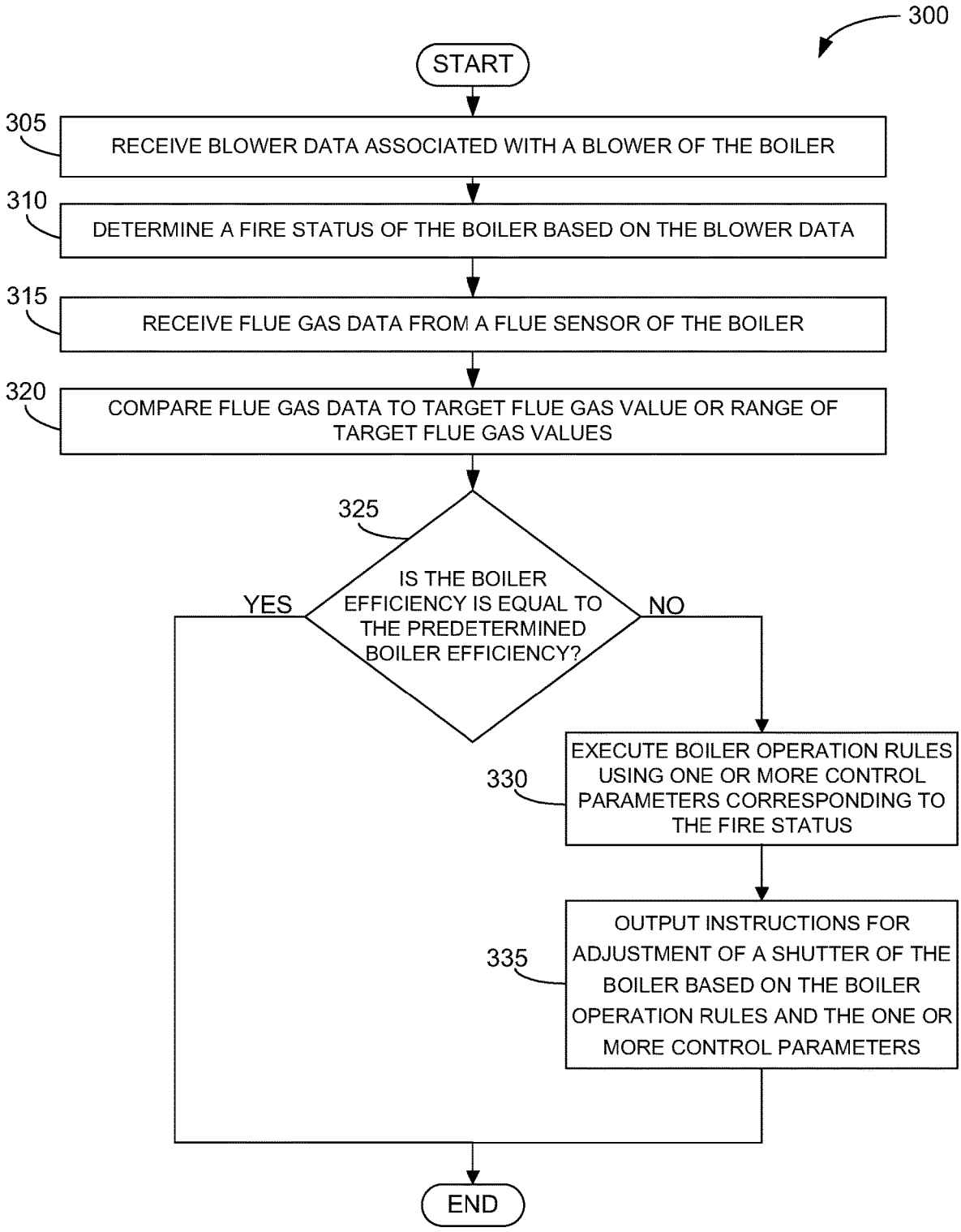
FIG. 3 illustrates a flowchart of an example method for controlling a boiler to achieve efficient combustion, in accordance with the disclosed technology.

FIG. 3 illustrates a flowchart of an example method 300 for controlling a boiler (e.g., boiler 210A) to achieve efficient combustion. Some or all of the method 300 can be performed by a boiler itself (e.g., an integrated computing device of a boiler 210A), and/or some or all of the method 300 can be performed by a separate computing device (e.g., computing device 220).

The method 300 can include receiving 305 blower data from a blower of a boiler (e.g., boiler 210A) and determining 310 a fire status of the boiler based on the blower data. As described above, the fire status can be one of a plurality of fire statuses. For example, the fire status can be a high-fire status (e.g., corresponding to a range of high firing rates), a mid-fire status (e.g., corresponding to a range of mid-range firing rates), and/or a low-fire status (e.g., corresponding to a range of low firing rates).

The method 300 can include receiving 315 flue gas data from a flue gas sensor of the boiler, such as from an oxygen sensor located at or near the flue. The method 300 can include comparing 320 the flue gas data to a target flue gas value or a target range of flue gas values. Based on the comparison, the method 300 can include determining 325 whether there is efficient combustion for the current fire status.

If the flue gas data does not satisfy the target flue gas value or a target range of flue gas values, the method 300 can include executing 330 one or more boiler operation rules using one or more parameters corresponding to the fire status. The parameter(s) can correspond to, and be specific to, each respective fire status, such as one or more high-fire parameters corresponding to the high-fire status, one or more mid-fire parameters corresponding to the mid-fire status, and/or one or more low-fire parameters corresponding to the low-fire status. That is, for example, if the fire status is a high-fire status, the method 300 can include executing 330 the boiler operation rule(s) using the high-fire parameter(s); if the fire status is a mid-fire status, the method 300 can include executing 330 the boiler operation rule(s) using the mid-fire parameter(s); and if fire status is a low-fire status, the method 300 can include executing 330 the boiler operation rule(s) using the low-fire parameter(s).

The method 300 can include outputting 335 instructions for adjustment of a shutter of the boiler based on the boiler operation rule(s) and the fire-specific parameter(s). Optionally, the instructions can include a speed by which the shutter is instructed to open or close. Thus, the method 300 can include outputting instructions for an amount of adjustment by the shutter, as well as a speed by which the shutter should adjust. The speed by which the shutter should adjust can be based on the current fire status of the boiler. For example, a high-fire status can correspond to a relatively fast adjustment speed of the shutter, and conversely, a low-fire status can correspond to a relatively slow adjustment speed of the shutter. A mid-fire status can correspond to an adjustment speed that is between the fast adjustment speed associated with the high-fire status and the slow adjustment speed associated with the low-fire status.

Figure 4:
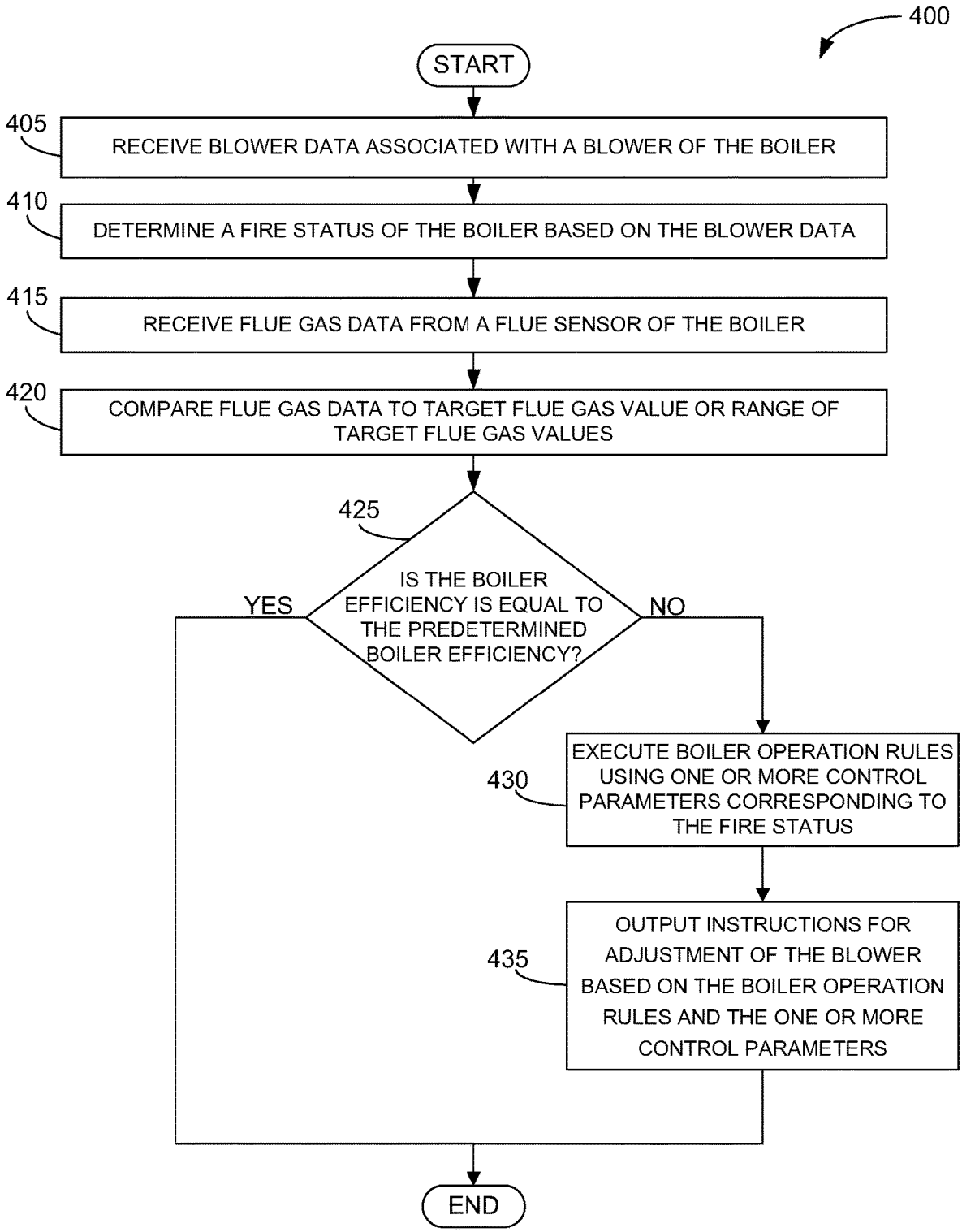
FIG. 4 illustrates a flowchart of another example method for controlling a boiler to achieve efficient combustion, in accordance with the disclosed technology.

Referring now to FIG. 4, the disclosed technology includes a method 400 for controlling a boiler (e.g., boiler 210A) to achieve efficient combustion. The method 400 can include receiving 405 blower data, receiving 415 flue gas data, comparing 420 the flue gas data to a target flue gas value or a target range of flue gas values, and determining 425 whether there is efficient combustion for the current fire status, such as is described above with respect to method 300. Likewise, if the flue gas data does not satisfy the target flue gas value or a target range of flue gas values, the method 400 can include executing 430 one or more boiler operation rules using one or more parameters corresponding to the fire status. The parameter(s) can correspond to, and be specific to, each respective fire status, as described above.

The method 400 can include outputting 435 instructions for adjustment of the blower based on the boiler operation rule(s) and the fire-specific parameter(s). That is, the instructions can instruct the blower to increase or decrease the blower speed and/or output based on the boiler operation rule(s) and the specific parameter(s) corresponding to the current fire status of the boiler. Optionally, the instructions can include a speed by which the blower is instructed to increase or decrease speed and/or output. As with the adjustment amount, the speed by which the blower should adjust can be based on the current fire status of the boiler. For example, a high-fire status can correspond to a relatively fast adjustment speed of the blower, and conversely, a low-fire status can correspond to a relatively slow adjustment speed of the blower. A mid-fire status can correspond to an adjustment speed that is between the fast adjustment speed associated with the high-fire status and the slow adjustment speed associated with the low-fire status.

The disclosed technology also includes methods for controlling a boiler to achieve efficient combustion by combining methods 300 and 400. That is, the disclosed technology includes outputting both instructions to adjust the shutter, thereby changing the amount of fuel being inputted into a combustion chamber of the boiler, and instructions to adjust the blower, thereby changing the amount of air being inputted into the combustion chamber. Accordingly, the air-fuel ratio can be adjusted, which can impact combustion efficiency.

Referring now to FIG. 6, some or all of the method 300 and/or 400 can be performed by, and/or in conjunction with, the boiler 210A. As discussed below, the boiler 210A can comprise a controller 502A (e.g., a PID controller) and boiler components. The controller 502A can include one or more processors 504A, memory 506A, a transceiver 508A, and/or a display 510A. The boiler can include subcomponents, such as one or more blowers 512A, one or more pumps 514A, one or more sensors 516A, and/or one or more actuators 518A. As described above, the controller 602A can be configured to perform some or all of the methods 300 and/or 400. Of course, the transceiver 408A can transmit boiler data to the computing device 220 or another device and receive instructions from the computing device 220 or another device.

The controller 602A can instruct control of the functions of the boiler 210A, such as the temperature of water heated by the boiler, for example. The blower 512A can provide air for combustion, and the pump(s) 514A can move fluids (e.g., water) through the boiler, for example. The sensor(s) 516A can monitor and/or detect various characteristics or other information regarding the boiler 210A, the water passing through the boiler, or other aspects, such as environmental conditions. The actuator(s) 518A can transition or otherwise cause the movement of various valve(s), shutter(s), and the like.

In this description, numerous specific details have been set forth. It is to be understood, however, that implementations of the disclosed technology may be practiced without these specific details. In other instances, well-known methods, structures, and techniques have not been shown in detail in order not to obscure an understanding of this description. References to "one embodiment," "an embodiment," "some examples," "example embodiment," "various examples," "one implementation," "an implementation," "example implementation," "various implementations," "some implementations," etc., indicate that the implementation(s) of the disclosed technology so described may include a particular feature, structure, or characteristic, but not every implementation necessarily includes the particular feature, structure, or characteristic. Further, repeated use of the phrase "in one implementation" does not necessarily refer to the same implementation, although it may.

Throughout the specification and the claims, the following terms take at least the meanings explicitly associated herein, unless the context clearly dictates otherwise. The term "connected" means that one function, feature, structure, or characteristic is directly joined to or in communication with another function, feature, structure, or characteristic. The term "coupled" means that one function, feature, structure, or characteristic is directly or indirectly joined to or in communication with another function, feature, structure, or characteristic. The term "or" is intended to mean an inclusive "or." Further, the terms "a," "an," and "the" are intended to mean one or more unless specified otherwise or clear from the context to be directed to a singular form. By "comprising," "containing," or "including" it is meant that at least the named element, or method step is present in article or method, but does not exclude the presence of other elements or method steps, even if the other such elements or method steps have the same function as what is named.

As used herein, unless otherwise specified the use of the ordinal adjectives "first," "second," "third," etc., to describe a common object, merely indicate that different instances of like objects are being referred to, and are not intended to imply that the objects so described must be in a given sequence, either temporally, spatially, in ranking, or in any other manner.

While certain examples of this disclosure have been described in connection with what is presently considered to be the most practical and various examples, it is to be understood that this disclosure is not to be limited to the disclosed examples, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain examples of the technology and also to enable any person skilled in the art to practice certain examples of this technology, including making and using any apparatuses or systems and performing any incorporated methods. The patentable scope of certain examples of the technology is defined in the claims and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A method for dynamically controlling a boiler, the method comprising:

receiving flue gas data from a flue gas sensor of the boiler;

receiving blower data associated with a blower of the boiler;

determining, based at least in part on the blower data, a current fire status of at least two fire statuses of the boiler;

providing one or more fire-status-specific parameters based on the current fire status of the boiler;

comparing the flue gas data to a target flue gas value;

in response to determining that the flue gas data is indicative of a flue gas concentration that is less than the target flue gas value, executing one or more boiler operation rules using the one or more fire-status-specific parameters; and outputting instructions for a continuous adjustment of an air-fuel ratio of the boiler based on the boiler operation rules and the one or more fire-status-specific parameters, wherein the adjustment is implemented via both (i) opening or closing of a fuel shutter at a speed selected from a first set of speeds, and (ii) increasing or decreasing the current blower output at a speed selected from a second set of speeds.

2. The method of claim 1, wherein outputting instructions for the continuous adjustment of the air-fuel ratio comprises:

outputting instructions for the fuel shutter to open a certain amount based on the boiler operation rules and the one or more fire-status-specific parameters; or outputting instructions for the fuel shutter to close a certain amount based on the boiler operation rules and the one or more fire-status-specific parameters.

3. The method of claim 2, wherein outputting instructions for the continuous adjustment of the air-fuel ratio comprises:

outputting instructions for the fuel shutter to open or close at the selected speed based on the boiler operation rules and the one or more fire-status-specific parameters.

4. The method of claim 1, wherein outputting instructions for the continuous adjustment of the air-fuel ratio comprises:

outputting instructions for the blower to increase a current blower output based on the boiler operation rules and the one or more fire-status-specific parameters; or outputting instructions for the blower to decrease a current blower output based on the boiler operation rules and the one or more fire-status-specific parameters.

5. The method of claim 4, wherein outputting instructions for the continuous adjustment of the air-fuel ratio comprises:

outputting instructions for the blower to increase or decrease the current blower output at a certain rate of change based on the boiler operation rules and the one or more fire-status specific parameters.

6. The method of claim 1, wherein providing the one or more fire-status-specific parameters comprises:

providing one or more high-fire parameters if the current fire status of the boiler is a high-fire status;

providing one or more mid-fire parameters if the current fire status of the boiler is a mid fire status; or providing one or more low-fire parameters if the current fire status of the boiler is a low fire status.

7. The method of claim 1 further comprising:

receiving updated flue gas data and updated blower data;

determining an updated current fire status of the boiler based at least in part on the updated blower data;

providing one or more updated fire-status-specific parameters based on the updated current fire status of the boiler;

comparing the updated flue gas data to the target flue gas value;

in response to determining that the updated flue gas data is indicative of an updated flue gas concentration that is less than the target flue gas value, executing the one or more boiler operation rules using the one or more updated fire-status-specific parameters; and outputting updated instructions for adjustment of the air-fuel ratio of the boiler based on the boiler operation rules and the one or more fire-status-specific parameters.

8. The method of claim 1 further comprising:

displaying, by a display, at least one of the flue gas data, the blower data, a determined combustion efficiency of the boiler, and the current fire status of the boiler.

9. The method of claim 1, wherein the flue gas data comprises at least one of:

carbon dioxide data indicative of a concentration of carbon dioxide in a flue of the boiler; and carbon monoxide data indicative of a concentration of carbon dioxide in a flue of the boiler.

10. A non-transitory, computer-readable medium having instructions stored thereon that, when executed by one or more processors, cause a system to:

receive flue gas data from a flue gas sensor of a boiler associated with the system;

receive blower data associated with a blower of the boiler;

determine, based at least in part on the blower data, a current fire status of at least two fire statuses of the boiler;

provide one or more fire-status-specific parameters based on the current fire status of the boiler;

compare the flue gas data to a target flue gas value;

in response to determining that the flue gas data is indicative of a flue gas concentration that is less than the target flue gas value, execute one or more boiler operation rules using the one or more fire-status-specific parameters; and output instructions for adjustment of an air-fuel ratio of the boiler based on the boiler operation rules and the one or more fire-status-specific parameters, wherein the adjustment is implemented via both (i) opening or closing of a fuel shutter at a speed selected from a first set of speeds, and (ii) increasing or decreasing the current blower output at a speed selected from a second set of speeds.

11. The non-transitory, computer-readable medium of claim 10, wherein outputting instructions for adjustment of the air-fuel ratio comprises:

outputting instructions for a fuel shutter to open the certain amount based on the boiler operation rules and the one or more fire-status-specific parameters; or outputting instructions for the fuel shutter to close a certain amount based on the boiler operation rules and the one or more fire-status-specific parameters.

12. The non-transitory, computer-readable medium of claim 11, wherein outputting instructions for adjustment of the air-fuel ratio comprises:

outputting instructions for the fuel shutter to open or close at the selected speed based on the boiler operation rules and the one or more fire-status-specific parameters.

13. The non-transitory, computer-readable medium of claim 10, wherein outputting instructions for adjustment of the air-fuel ratio comprises:

outputting instructions for the blower to increase a current blower output based on the boiler operation rules and the one or more fire-status-specific parameters; or outputting instructions for the blower to decrease a current blower output based on the boiler operation rules and the one or more fire-status-specific parameters.

14. The non-transitory, computer-readable medium of claim 13, wherein outputting instructions for adjustment of the air-fuel ratio comprises:

outputting instructions for the blower to increase or decrease the current blower output at a certain rate of change based on the boiler operation rules and the one or more fire-status specific parameters.

15. The non-transitory, computer-readable medium of claim 10, wherein providing the one or more fire-status-specific parameters comprises:

providing one or more high-fire parameters if the current fire status of the boiler is a high-fire status;

providing one or more mid-fire parameters if the current fire status of the boiler is a mid fire status; or providing one or more low-fire parameters if the current fire status of the boiler is a low fire status.

16. The non-transitory, computer-readable medium of claim 10, wherein the instructions, when executed by the one or more processors, further cause the system to:

output for display, by a display associated with the system, at least one of the flue gas data, the blower data, a determined combustion efficiency of the boiler, and the current fire status of the boiler.

17. The non-transitory, computer-readable medium of claim 10, wherein the flue gas data comprises excess of oxygen data.

18. A boiler controller comprising the non-transitory, computer-readable medium and the one or more processors of claim 10.

19. A boiler comprising the boiler controller of claim 18.

* * * * *